US009821945B2

(12) United States Patent
Kuhn et al.

(10) Patent No.: US 9,821,945 B2
(45) Date of Patent: Nov. 21, 2017

(54) TRANSPORT CONTAINER FOR TRANSPORT-SENSITIVE GOODS

(71) Applicant: VA-Q-TEC AG, Würzburg (DE)

(72) Inventors: Joachim Kuhn, Würzburg (DE); Fabian Eschenbach, Rottendorf (DE); Martin Heinemann, Würzburg (DE); Thomas Taraschewski, Würzburg (DE); Tobias Bock, Würzburg (DE)

(73) Assignee: VA-Q-TEC AG, Wurzburg (DE)

( * ) Notice: Subject to any disclaimer, the term of this patent is extended or adjusted under 35 U.S.C. 154(b) by 0 days.

(21) Appl. No.: 15/122,989

(22) PCT Filed: Feb. 24, 2015

(86) PCT No.: PCT/EP2015/000412

§ 371 (c)(1),
(2) Date: Sep. 1, 2016

(87) PCT Pub. No.: WO2015/131982

PCT Pub. Date: Sep. 11, 2015

(65) Prior Publication Data

US 2017/0073146 A1 Mar. 16, 2017

(30) Foreign Application Priority Data

Mar. 5, 2014 (DE) ..... 20 2014 001 923 U
May 7, 2014 (DE) ..... 20 2014 003 782 U

(51) Int. Cl.
*B65D 81/38* (2006.01)
*A45C 11/20* (2006.01)
(Continued)

(52) U.S. Cl.
CPC ..... *B65D 81/3816* (2013.01); *A45C 11/20* (2013.01); *A45C 13/1092* (2013.01);
(Continued)

(58) Field of Classification Search
CPC ..... B65D 81/38; B65D 81/3816; B65D 81/3813; B65D 43/02; B65D 43/16;
(Continued)

(56) References Cited

U.S. PATENT DOCUMENTS 5,765,707 A 6/1998 Kenevan
2003/0042264 A1* 3/2003 Stanwix ..... F25D 3/14 220/592.21

(Continued)

FOREIGN PATENT DOCUMENTS

DE 1820935 11/1960
DE 1805646 5/1970

(Continued)

OTHER PUBLICATIONS

International Search Report, PCT/EP2015/000412, dated May 15, 2015.

*Primary Examiner* — Robert J Hicks
(74) *Attorney, Agent, or Firm* — Andrus Intellectual Property Law, LLP

(57) ABSTRACT

A transport container is made of a trough-like lower part which is open towards the top and an upper part which is arranged on the lower part and closes the open upper side of the lower part. The upper part can be removed or pivoted in order to open the lower part, and the lower part and the upper part preferably consist of a dimensionally stable plastic material. The lower part has a base, longitudinal walls, and transverse walls, and the upper part correspondingly has a cover, longitudinal faces, and transverse faces. The lower part has transversally running flat recessed package-band cutouts at least on the longitudinal walls and preferably on the base as well, and the upper part has transversally running flat recessed package-band cutouts at least on the longitu-
(Continued)

dinal faces and preferably on the lid as well, the recesses being flush with one another and facing one another.

13 Claims, 6 Drawing Sheets

(51) Int. Cl.

| | |
|---|---|
| ***A45C 13/10*** | (2006.01) |
| ***A45C 13/30*** | (2006.01) |
| ***A45F 3/14*** | (2006.01) |
| ***F25D 3/08*** | (2006.01) |
| ***B65D 43/02*** | (2006.01) |
| ***B65D 43/16*** | (2006.01) |

(52) U.S. Cl.
CPC ..... *A45C 13/30* (2013.01); *A45F 3/14* (2013.01); *B65D 43/02* (2013.01); *B65D 43/16* (2013.01); *B65D 81/3813* (2013.01); *F25D 3/08* (2013.01)

(58) Field of Classification Search
CPC ..... B65D 25/2876; B65D 25/2802; B65D 21/0233; A45C 11/20; A45C 13/1092; A45C 13/30; A45F 3/14; A45F 5/10; F25D 3/08
USPC .... 220/754, 755, 915.1, 915.2, 770, 592.03; 217/66
See application file for complete search history.

(56) References Cited

U.S. PATENT DOCUMENTS

| | | | | |
|---|---|---|---|---|
| 2004/0178208 | A1 | 9/2004 | Leba et al. | |
| 2006/0065655 | A1 | 3/2006 | Taylor | |
| 2010/0102057 | A1 | 4/2010 | Long et al. | |
| 2011/0168729 | A1* | 7/2011 | Koenig ..... | B65D 25/2858 220/761 |

FOREIGN PATENT DOCUMENTS

| | | |
|---|---|---|
| DE | 3730309 | 3/1989 |
| DE | 4211951 | 10/1993 |
| DE | 19535648 | 4/1997 |
| DE | 20020743 | 3/2001 |
| DE | 69512750 | 3/2005 |
| DE | 102012006743 | 10/2013 |
| EP | 0718212 | 6/1996 |
| WO | 2005/007519 | 1/2005 |

* cited by examiner

TRANSPORT CONTAINER FOR TRANSPORT-SENSITIVE GOODS

CROSS-REFERENCE TO RELATED APPLICATIONS

This application is the U.S. national stage application of International Application PCT/EP2015/000412, filed Feb. 24, 2015, which international application was published on Sep. 11, 2015, as International Publication WO 2015/131982 in the English language. The International Application claims priority of German Patent Application No. 202014001923.1, filed Mar. 5, 2014 and German Patent Application No. 202014003782.5, filed May 7, 2014. The international application and German applications are incorporated herein by reference, in entirety.

FIELD

The invention relates to a transport container for transport-sensitive goods.

BACKGROUND

The transport of transport-sensitive goods, in particular temperature-sensitive goods, has been a subject for decades. Thus, DE 695 12 750 T2 describes in general terms a plethora of container constructions which are produced from polymer materials on their own or in combination with cardboard or wooden boxes. One conventional embodiment of a cardboard box filled with foam particles which surround a second cardboard box, which then contains the transport-sensitive goods that are relevant per se, is mentioned as are plastic containers which are filled with open-cell or closed-cell plastic. Reference is also made to transport containers with evacuated walls.

The prior art also mentions cooling units in the transport container, which are filled with phase-change material and are capable of maintaining a predefined target temperature over a long time.

In the present case, the invention deals with the handling of a transport container of the type in question. Such transport containers have already been known per se for decades.

The transport container for blood bags, which forms the starting point for the teaching of the present patent application, was described in 1960 (DE 1 820 935 A). This transport container has a lower part and an upper part made of Styrofoam or another insulating plastic. Provided in the lower part are holding chambers for the blood bottles, which are on view there, while the upper part has moldings which correspond to the bottle tops. The blood bottles are put into the lower part. As a result of fitting the upper part, the bottles are fixed in the transport container and are surrounded by the insulating layer of Styrofoam or other insulating material. In order that the upper part sits firmly on the lower part and seals off the interior safely, the upper part reaches into a corresponding recess in the lower part by means of a rebate.

During the transport of the transport-sensitive goods, the transport container must be closed securely. To this end, the upper part and the lower part are closed at the contacting edge by an adhesive strip. This adhesive strip can also be configured as a type of seal, in order to identify damage and accordingly unauthorized opening.

A lower part and an upper part of the known transport container can be provided on the outside with a shell made of hard plastic.

The data relating to the transport-sensitive goods located in the transport container can be recorded on the cover of the upper part.

The known transport container must be gripped on the right and left with both hands during transport and carried individually as a block.

For the transport of multiple transport containers, it would moreover be expedient if these could be stacked securely.

Finally, the upper part of the transport container is pushed onto the lower part with a frictional fit and it is therefore not simple to release the upper part from the lower part again in order to open the transport container.

SUMMARY

The teaching of the invention is based on the object of providing a solution for one or more of the previously indicated problems in a transport container of the type under discussion.

The lower part and upper part of the transport container are provided with transversely running flat recessed strapping cutouts, at least on the longitudinal sides or longitudinal walls, preferably also on the base and on the cover. These are arranged and oriented to be aligned with one another. Accordingly, the transport container is prepared to receive one or more straps running around the upper part and lower part of the transport container in the strapping cutouts. By means of the strapping cutouts, the precondition is created for the strap or the straps not to be able to slip off the transport container toward the side. They rest in the flat recessed strapping cutouts.

If multiple narrow straps are provided, then, for example, two straps can be provided with carrying handles, with which the transport container can be carried, on the upper side. The third, central strap can, for example, serve as a closing strap with a turnbuckle or a seal.

It is important that the transport container as such is in the first instance correspondingly configured in order to create the preconditions for the purposeful handling of the transport container.

According to the teaching, the transport container can further be configured, for example, by the lower part having on the transverse walls flat recessed connecting cutouts running substantially parallel to the base and reaching as far as the strapping cutouts, and, preferably, also flat recessed intermediate cutouts running perpendicular to the base and reaching as far as the connecting cutouts on the transverse walls and into the strapping cutout on the base.

It has already been pointed out in regard to the prior art that thick-walled foam plastic material is particularly expediently suitable for the transport container. Of particular advantage from the current point of view, in addition to the Styrofoam already known, is in particular expanded polypropylene (EPP), which is resistant and can be densely foamed.

Up to now, only the transport container as such with the lower part and upper part has been described.

Of particular advantage is the configuration of the transport container having only one strapping cutout each on the respective longitudinal wall, the base or the cover, wherein the respective strapping cutout assumes approximately the full width of the respective longitudinal wall, of the base or of the cover. Apart from bounding edges of low width, the substantially full width is therefore assumed by the strapping cutout of the respective longitudinal wall, the base or the cover.

According to preferred teaching, the transport container according to the invention will be provided from the start with a corresponding strap. It is recommended for the lower part and the upper part together to be enclosed tautly by a strap arranged in the strapping cutouts.

The term "enclosed tautly" is intended to illustrate that the strap is placed so tightly around the lower part and upper part in the strapping cutouts such that it cannot be pulled off laterally and that the upper part cannot be raised substantially from the lower part either. The interior of the transport container is intended to be protected reliably against access by the straps.

In the preferred configuration of the transport container mentioned previously, in which the strapping cutouts arranged to align with one another assume approximately the full width of the respective longitudinal wall, base or cover, it is recommended also to provide exactly one large-area circumferential strap in a corresponding way, the width of which is slightly less than the width of the strapping cutouts. The large-area, wide strap encloses the transport container as a strip which is almost as wide as the transport container overall. The wide strap therefore also forms a good protection for the surface of the transport container in the area of the strapping cutouts and in the surface areas of the transport container that are located in between.

Preferably, the strap can be opened and closed again. The strap is therefore a reusable part. However, it is also possible to implement a disposable strap; therefore to destroy the strap when opening the transport container. If the strap can be opened and closed again, then it is recommended for the strap to have a typical buckle as is used in all types of harness.

If the strap as such is arranged only in the strapping cutouts, then it can theoretically be displaced in the strapping cutouts on the transport container. If it is wished to ensure a stable position of the strap, then it is recommended that the strap be provided with connecting belts running in the connecting cutouts and, if present, also in the intermediate cutouts, so that the strap and the connecting belts together form a holding and carrying harness of the transport container. In this case, it is preferable for the connecting belts running in the intermediate cutouts on the base of the lower part to be connected to one another or to be implemented as a single continuous connecting belt.

In the prior art, in practice the transport containers described at the beginning have occasionally been placed in transport bags, the transport bags have been closed and the transport containers transported in the transport bag. This is firstly impractical, since the transport container is difficult to get into the transport bag, and is secondly expensive, since the material of the transport bag is overall expensive, and is finally not purposeful, since, for example, the transport bags cannot be stacked well.

According to the invention, with the transport container the basis is now created to arrange for the latter to be surrounded by a type of carrying harness equipped only with the connecting belts which are required for fixing the strap on the transport container and for the smooth carrying of the transport container.

In a particularly preferred embodiment, in particular the connecting belt running on the base is that which fixes the strap securely on the transport container.

The connecting belts can otherwise expediently be used for the provision of carrying loops, with which the transport container can then be carried.

As to the material configuration of the straps and the connecting belts, the strap consists of a woven fabric, a knitted fabric, a film or a tarpaulin, preferably made of plastic, and/or that the connecting belts consist of a woven fabric or a knitted fabric, possibly also of a film or a tarpaulin, likewise preferably made of plastic.

A further special feature, to which independent inventive significance is ascribed, consists in the case of the transport container configured in accordance with the invention in that stacking projections projecting upward are provided on the upper part, on the cover, in particular laterally beside the strapping cutout, and stacking cutouts directed upward and matching the stacking projections are provided on the lower part on the base, in particular laterally beside the strapping cutout. Since the transport container has no sleeve on the outside, but only bears the harness toward the outside but not projecting, the transport container can be stacked excellently if appropriate stacking projections and stacking cutouts are set up.

Reference has already been made in the prior art to external coating of the lower part and of the upper part with a hard plastic in order to keep the transport container as insensitive as possible on the outside. Modern expanded plastics are, however, already relatively resistant to this extent. It is sufficient here if, according to preferred teaching, provision is made for the lower part to be provided on the base with a base trough made of hard plastic or metal (which, of course, must have corresponding cutouts like the base body of the lower part).

Furthermore, in relation to the prior art, reference has already been made at the start to the fact that although the frictional connection of the upper part to the lower part is expedient, it is then possible to pull the upper part of the lower part only with considerable expenditure of force.

According to the invention, it has been recognized that the upper part can be divided more easily from the lower part if the force is specifically applied from one corner. Accordingly, according to further, independent teaching, provision is made for the upper part and the lower part to have ledges, cutouts or the like matching one another exactly on the mutually facing edges, and for the upper part to be pushed onto the lower part with a frictional fit, and for a grip cutout for the manual lifting of the upper part from the lower part to be provided on at least one corner between longitudinal wall and transverse wall, at the transition from the lower part to the upper part.

In addition, on the upper part on the right and left on the respective transverse side, a handle molding can also further be provided, in order to be able to carry the upper part easily when it is then taken off.

BRIEF DESCRIPTION OF THE DRAWINGS

In the following text, the invention will now be explained more closely in detail by using the description of a preferred exemplary embodiment, not to be understood as restrictive. This is done by using the drawing, in which.

DETAILED DESCRIPTION

Figure 1:
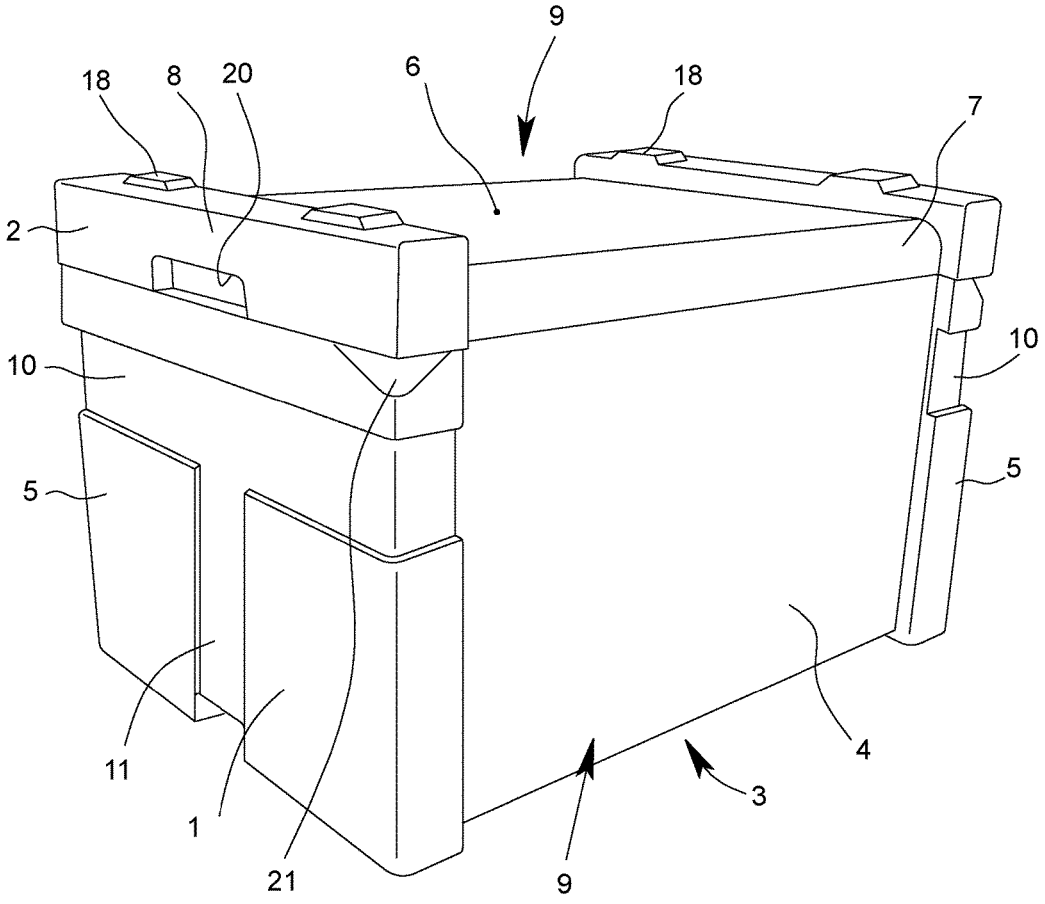
FIG. 1 shows an exemplary embodiment of a transport container according to the invention in a perspective illustration, closed.

The transport container illustrated in FIG. 1 is used for the transport of transport-sensitive goods such as blood, drugs, laboratory samples or the like.

The transport container illustrated in FIG. 1 firstly has a trough lower part 1 open at the top (FIG. 2) and, arranged on the lower part 1, an upper part 2 closing the open upper side of the lower part 1. The lower part 1 and the upper part 2 preferably consist of plastic material, particularly preferably and illustrated of a thick-walled foamed plastic material. Such a preferred material simultaneously leads to stable temperature control of the goods in the transport container and to protection of the goods against impacts or other mechanical stresses.

In order to illustrate the individual features of the transport container according to the invention, reference is made to FIGS. 1 to 6 in combination. Some features can be seen only from individual figures thereof.

The lower part 1 is shaped like a trough and has a base 3, longitudinal walls 4 and transverse walls 5, while the lid-like upper part 2 has a cover 6 and longitudinal sides 7 and transverse sides 8. At least on the longitudinal walls 4, preferably also on the base 3, the lower part 1 is provided with transversely running, flat recessed strapping cutouts 9. Corresponding strapping cutouts 9 are found on the longitudinal sides 7, preferably also on the cover 6, of the upper part 2. The strapping cutouts 9 on the lower part 1 and upper part 2 are arranged and oriented so as to align with one another.

In principle, it would be sufficient to arrange strapping cutouts 9 on the longitudinal walls 3 and longitudinal sides 7. A strap enclosed therein could not slip off the transport container to the right or left. However, the exemplary embodiment that is illustrated and particularly preferred shows strapping cutouts 9 running around on the lower part 1 and upper part 2, that is to say also on the base 3 and cover 6.

To this extent, the exemplary embodiment that is illustrated and preferred shows a preferred embodiment in that the strapping cutouts 9 arranged to align with one another each approximately assume the full width of the respective longitudinal wall 4, of the base 3 or of the cover 6. Only still narrow sections of the transport container, which form the transverse walls 5, are seen on the right and left of the strapping cutouts 9.

FIG. 1 shows further special features of the transport container according to the invention in such a way that the lower part 1 has on the transverse walls 5 flat recessed connecting cutouts running substantially parallel to the base 3 and reaching into the strapping cutouts 9. According to further preferred teaching, which then completes the matter, provision is further made that, in addition, flat recessed intermediate cutouts 11 running perpendicular to the base 3 and reaching as far as the connecting cutouts 10 on the transverse walls 5 and into the strapping cutout 9 on the base 3 of the lower part 1 are provided.

On the outer side of the transport container, as a result of the shaping there, the arrangement of a holding harness to be assigned to the transport container at a given time but, because of the flat recessed cutouts, does not project or projects only a little to the outside, is reflected there.

Figure 2:
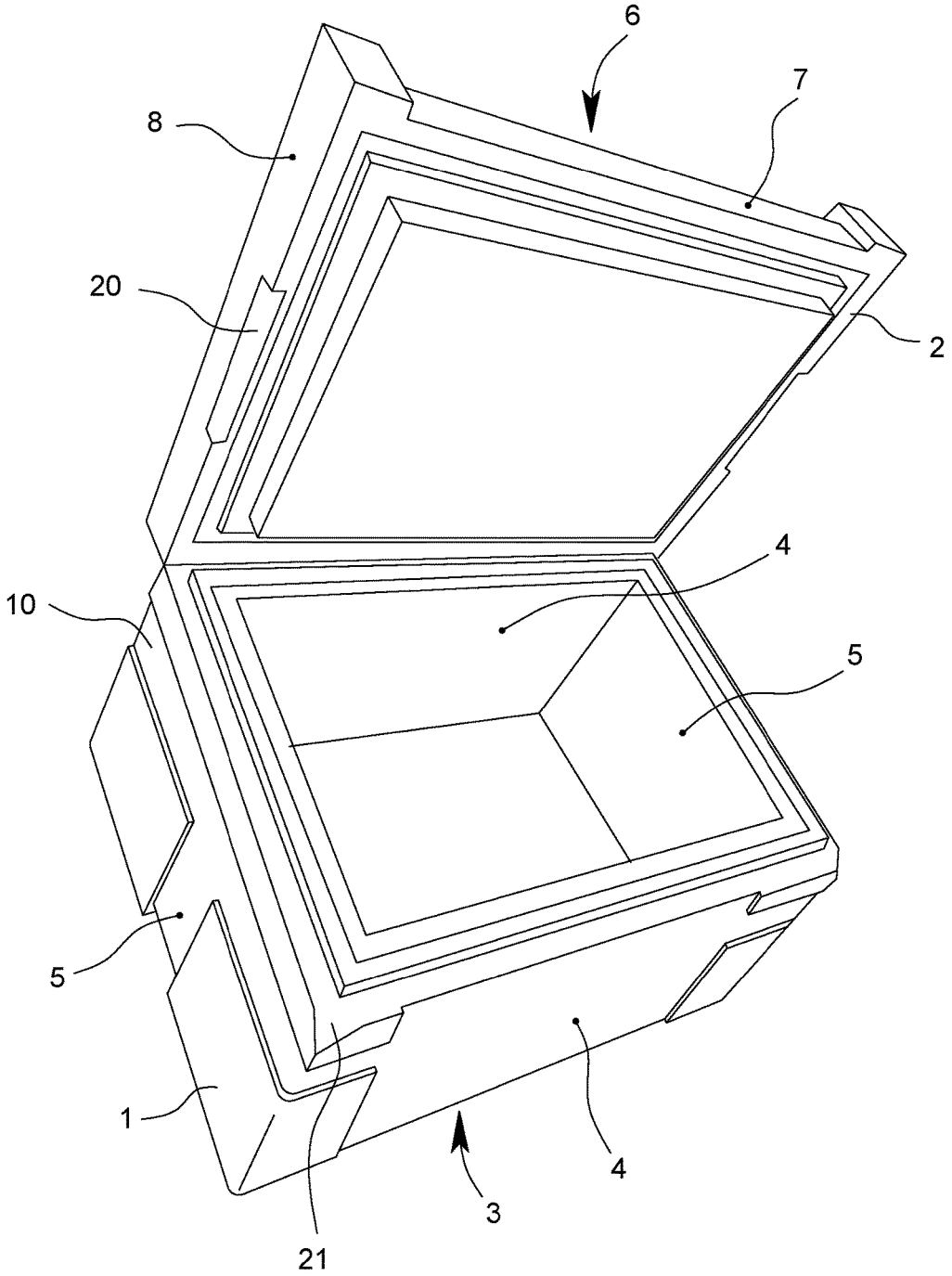
FIG. 2 shows the transport container from FIG. 1, opened.

FIG. 2 shows the upper part 2 taken off the lower part 1. The upper part 2 can be taken off the lower part 1 completely or it can also be pivotably fitted to the lower part 1. The exemplary embodiment that is illustrated and preferred shows a completely removable upper part 2.

In the exemplary embodiment that is illustrated and preferred, provision is otherwise made for lower part 1 and upper part 2 to consist of a thick-walled foamed plastic material, in particular of expanded polypropylene (EPP). Expanded polypropylene (EPP) is resistant, densely foamed and easily handled.

Figure 3:
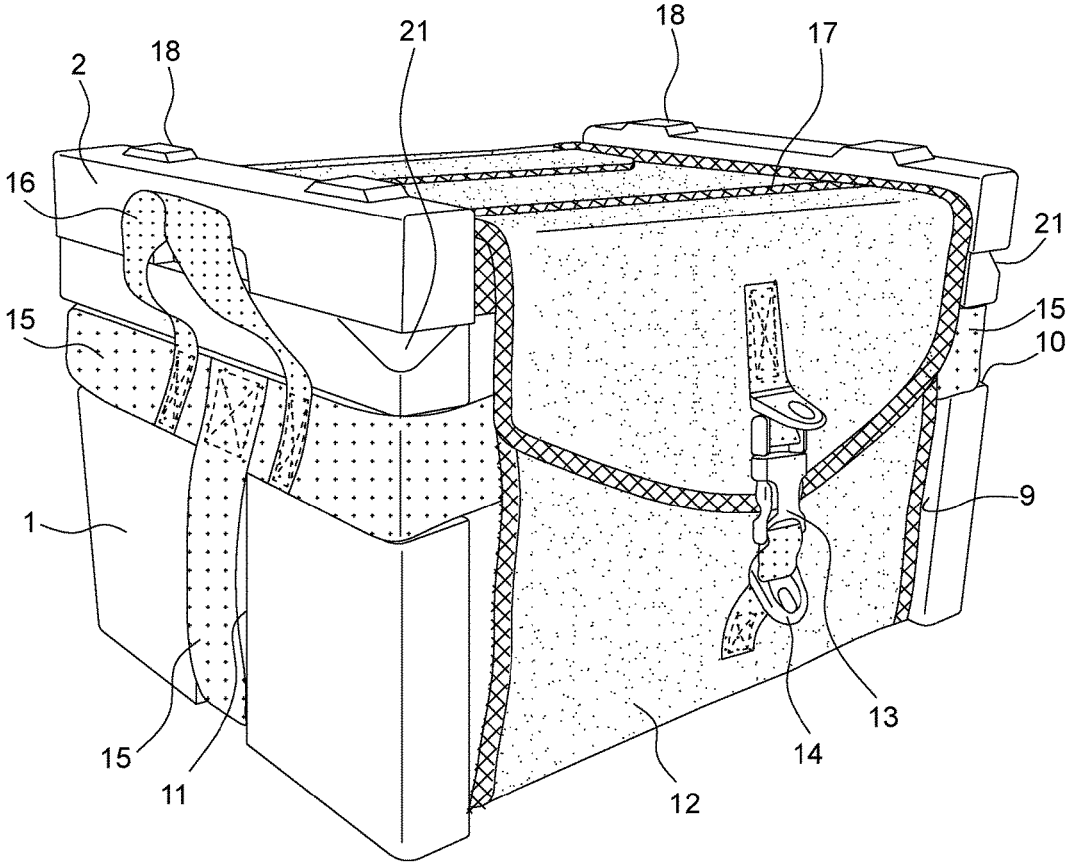
FIG. 3 shows the transport container from FIG. 1 in a perspective corresponding to FIG. 1, provided with a strap.

FIG. 3 shows the transport container according to the invention in conjunction with a holding and carrying harness surrounding the same. Not all the component parts of the holding and carrying harness are absolutely necessary for the invention in conjunction with a transport container according to the invention. The description will proceed step by step.

Firstly, provision is made here for the lower part 1 and the upper part 2 together to be enclosed tautly by a strap 12 arranged in the strapping cutouts 9.

The term "enclosing tautly" is intended to make it clear that, by means of the strap 12, the upper part 2 is held firmly on the lower part 1 and cannot be raised from the lower part 1 by more than a small amount which, however, does not permit any access into the interior of the transport container. The strap 12 should therefore consist of a material which has only a low elastic extensibility.

As has already been mentioned in the general part of the description, the strap 12 can be implemented as a disposable part and would then be removed following the opening of the strap 12.

The exemplary embodiment that is illustrated and preferred shows that, here, the strap 12 can be opened and closed again. In the exemplary embodiment that is illustrated and preferred, for this purpose the strap 12 has a buckle 13 on the front side of the transport container, which can be seen in FIG. 3.

In the exemplary embodiment that is illustrated and preferred, the transport container is not just closable overall by closing the strap 12. The transport container can also be sealed. For this purpose, use is made of closure eyelets 14 on the buckle 13 of the strap 12 illustrated, which can be connected by a padlock.

FIG. 3 shows a wide strap 12, which sits in the strapping cutouts 9 on the lower part 1 and upper part 2 and fills these strapping cutouts 9 substantially over the full width. This is the preferred exemplary embodiment of the invention.

In principle, however, it is also possible to arrange multiple straps 12 beside one another in the strapping cutouts 9, if necessary also at a distance from one another, or else to arrange multiple strapping cutouts 9 running around beside one another. In this regard, reference may be made to the explanations in the general part of the description.

The exemplary embodiment that is illustrated and preferred is configured still more advantageously with regard to the strap 12, namely in such a way that the strap 12 is provided with connecting belts 15 running in the connecting cutouts 10. Furthermore, intermediate cutouts 11 are also provided here in the preferred exemplary embodiment. Also found in these are connecting belts 15, which are connected to the strap 12.

Figure 4:
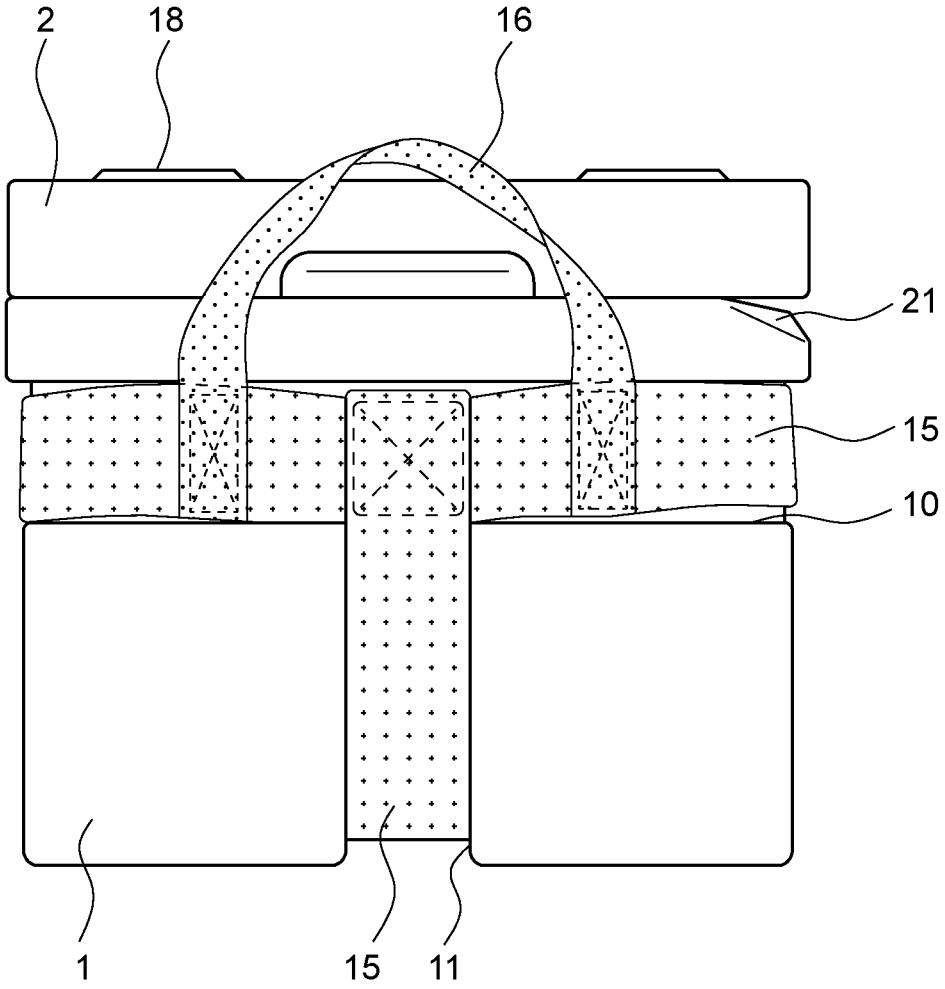
FIG. 4 shows the transport container from FIG. 3 from the side.
Figure 5:
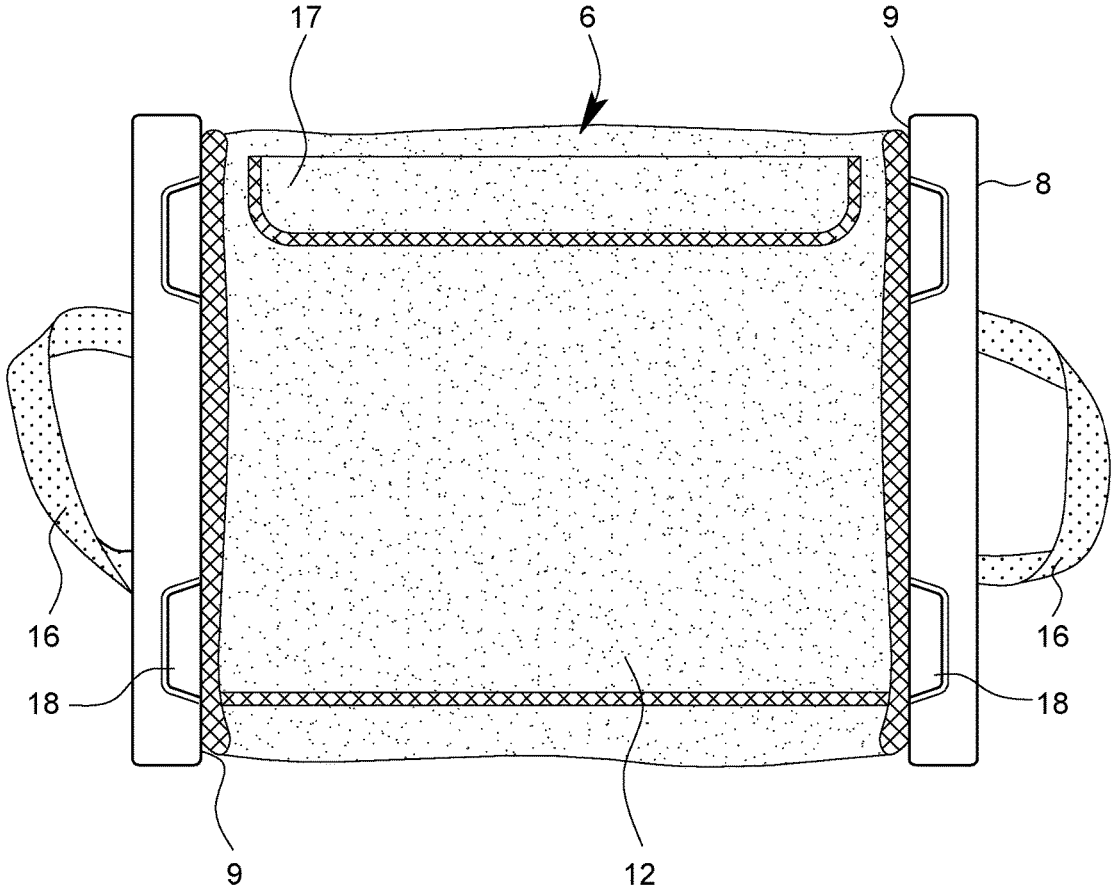
FIG. 5 shows the transport container from FIG. 3 from above.
Figure 6:
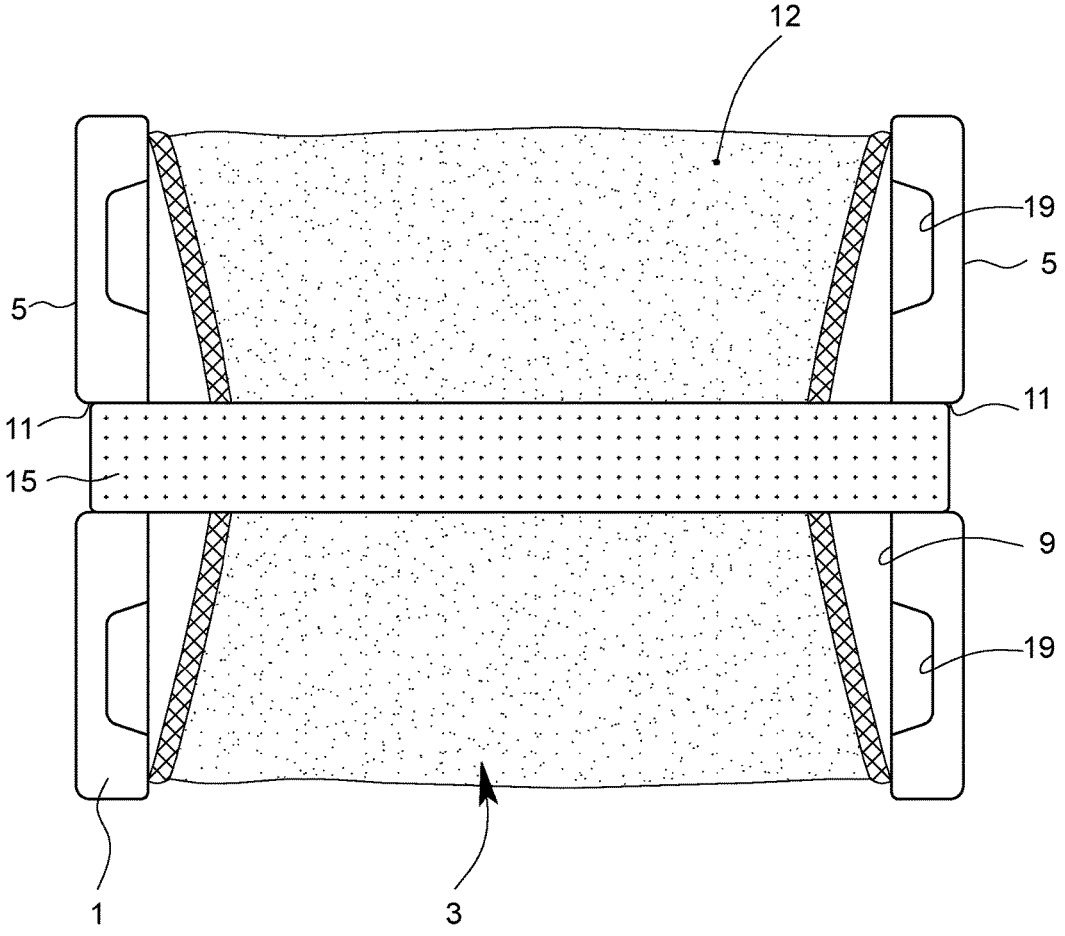
FIG. 6 shows the transport container from FIG. 3 from below.

Overall, according to particularly preferred teaching, the configuration of FIGS. 4 to 6 is implemented, with which the strap 12 and the connecting belts 15 overall form with one another the holding and carrying harness of the transport container.

It would be possible to fix the connecting belts 15 located in the intermediate cutouts 11 on the base of the lower part 1 only at the edge of the strap 12. However, the exemplary embodiment that is illustrated and preferred particularly expediently provides for the connecting belts 15 running in the intermediate cutouts 11 to be connected to one another on the base 3 of the lower part 1 or to be implemented as a single continuous connecting belt 15.

The connection of the connecting belts 15 to the strap 12, on the one hand, and to one another, on the other hand, can be carried out in any expedient manner appropriate to the materials used. Sewing, adhesive bonding, ultrasonic welding or thermal welding are particularly suitable.

According to further preferred teaching, provision is made for the holding and carrying harness also to be used to carry the transport container. To this end, as illustrated in FIGS. 3 and 4, provision is made for carrying loops 16 to be provided on the connecting belts 15.

For the configuration of the straps 12 and the connecting belts 15 and also the carrying loops 16, there are of course many possibilities. Particularly expedient are highly load-bearing fabrics made of synthetic fibers, for example of nylon. In principle, other materials are worth considering, for example knitted fabrics made of synthetic fibers, films, tarpaulin material or the like.

The exemplary embodiment that is illustrated and preferred shows the upper side of the upper part 2 of the transport container in FIG. 5. It can be seen that the strap 12 is also suitable for additional equipment details. Here, provision is made for an insertion pocket 17 for delivery documents, for example, to be located on the outside of the strap 12. As a result, it is possible to see immediately from above what is in the transport container.

FIGS. 1 and 6 in combination make clear a further special feature of the transport container according to the invention. This is because this transport container can be stacked very simply with other transport containers having the same equipment. For this purpose, use is made firstly of the fact that the strap 12 and the connecting belts 15 are countersunk in the corresponding cutouts 9, 10, 11 and do not project or project only a little outward. In particular, however, use is made of the fact that, in the exemplary embodiment illustrated, stacking projections 18 projecting upward are provided on the upper part 2 on the cover 3, laterally beside the strapping cutout 9, and stacking cutouts 19 directed upward and matching the stacking projections 18 are provided on the lower part 1, on the base 3 laterally beside the strapping cutout 9.

In the introduction to the description, reference has already been made to the prior art, which has proposed a coating made of hard plastic for the lower part 1 and upper part 2 of the transport container. However, the alternative, which is preferred in the present case, consists in the lower part 1 being provided with a base trough of hard plastic or metal, which then of course must have the same cutouts as the base body made of plastic. However, this is not illustrated in the drawing.

In FIG. 1, on the left on the transverse side 8 of the upper part 2, approximately centrally, it is possible to see a carrying cutout 20, at which the upper part 2 can conveniently be carried when it has been taken off the lower part 1. A corresponding carrying cutout is also found on the opposite transverse side of the upper part 2.

It has been shown that if the upper part 2 is edged completely and pushed onto the lower part 1 with a frictional fit, as illustrated here, in particular in the case of a rough, foamed plastic material, the expenditure of a great deal of force is needed to pull the upper part 2 upward off the lower part 1. According to the invention, provision is now made here for a grip cutout 21 for manually lifting the upper part 2 off the lower part 1 to be formed on at least one corner between longitudinal wall 4 and transverse wall 5, at the transition from lower part 1 to upper part 2. The application of force at a corner improves the introduction of force into the upper part 2 and leads to it being possible for the upper part 2 to be lifted cleanly off the lower part 1 with the expenditure of comparatively little force.

All embodiments disclosed herein may be used alone or in combination with each other.

The invention claimed is:

1. A transport container comprising:

a trough lower part with an upper side open toward a top and an upper part arranged on the trough lower part and closing the upper side of the trough lower part, wherein the upper part can be removed from the trough lower part or pivoted in order to open the trough lower part, wherein the trough lower part and the upper part are made of a dimensionally stable plastic material, wherein the trough lower part has a base, longitudinal walls and transverse walls, and the upper part correspondingly has a cover, longitudinal sides and transverse sides, wherein the trough lower part at least on the longitudinal walls and the upper part at least on the longitudinal sides have transversely running, flat recessed strapping cutouts that are arranged and oriented in alignment with one another when the upper part is on the trough lower part, and wherein the transversely running, flat recessed strapping cutouts, arranged in alignment with one another, each measure approximately a full width of the respective longitudinal wall and longitudinal side, respectively.

2. The transport container as claimed in claim 1, wherein the trough lower part has at least one transversely running strapping cutout also on the base and the upper part has at least one transversely running strapping cutout also on the cover, oriented in alignment with the transversely running, flat recessed strapping cutouts on the longitudinal walls and longitudinal sides and wherein also the transversely running strapping cutouts on the base and the cover each measure approximately a full width of the base and the cover, respectively.

3. The transport container as claimed in claim 2, wherein the trough like trough lower part has on the transverse walls flat recessed connecting cutouts running substantially parallel to the base and reaching as far as the transversely running, flat recessed strapping cutouts on the longitudinal walls, and also has flat recessed intermediate cutouts running perpendicular to the base, reaching as far as the flat recessed connecting cutouts on the transverse walls and into the transversely running, flat recessed strapping cutout on the base.

4. The transport container as claimed in claim 3, wherein the trough lower part and the upper part are held together by at least one strap arranged in the transversely running, flat recessed strapping cutouts, wherein the at least one strap can be opened and reclosed.

5. The transport container as claimed in claim 4, wherein the at least one strap is provided with connecting belts running in the flat recessed connecting cutouts so that the at least one strap and the connecting belts together form a holding and carrying harness of the transport container.

6. The transport container as claimed in claim 5, wherein the at least one strap is provided also with connecting belts running in the flat recessed intermediate cutouts and wherein said connecting belts are connected to one another on the base of the trough lower part.

7. The transport container as claimed in claim 6, wherein the connecting belts running in the flat recessed intermediate cutouts on the trough lower part are implemented as a single continuous connecting belt.

8. The transport container as claimed in claim 5, wherein carrying loops are provided on the connecting belts.

9. The transport container as claimed in claim 5, wherein the connecting belts are made of at least one of a woven fabric, a knitted fabric, a film, and a tarpaulin.

10. The transport container as claimed in claim 1, wherein the trough lower part and the upper part are made of a thick-walled foam plastic material.

11. The transport container as claimed in claim 1, wherein the trough lower part and the upper part are held together by at least one strap arranged in the transversely running, flat recessed strapping cutouts, wherein the at least one strap can be opened and reclosed.

12. The transport container as claimed in claim 11, wherein the at least one strap is a single strap, and wherein the trough lower part and the upper part are held together by the single strap, which is matched in width to the width of the transversely running, flat recessed strapping cutouts.

13. The transport container as claimed in claim 11, wherein the at least one strap is made of at least one of a woven fabric, a knitted fabric, a film, and a tarpaulin.

* * * * *